US008867938B2

(12) United States Patent
Hano

(10) Patent No.: US 8,867,938 B2
(45) Date of Patent: Oct. 21, 2014

(54) IMAGE FORMING APPARATUS FOR OPTICALLY DETECTING AND ADJUSTING A TONER IMAGE

(71) Applicant: Canon Kabushiki Kaisha, Tokyo (JP)

(72) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 45 days.

(21) Appl. No.: 13/717,135

(22) Filed: Dec. 17, 2012

(65) Prior Publication Data

US 2013/0156450 A1 Jun. 20, 2013

(30) Foreign Application Priority Data

Dec. 19, 2011 (JP) ..... 2011-277692

(51) Int. Cl.
*G03G 15/00* (2006.01)
*G03G 15/16* (2006.01)

(52) U.S. Cl.
CPC ..... *G03G 15/5041* (2013.01)
USPC ..... 399/49; 399/66

(58) Field of Classification Search
USPC ..... 399/49, 66
See application file for complete search history.

(56) References Cited

U.S. PATENT DOCUMENTS

2007/0242967 A1* 10/2007 Hano et al. ..... 399/49

FOREIGN PATENT DOCUMENTS

| | | | |
|---|---|---|---|
| JP | 8-83248 | A | 3/1996 |
| JP | 2002-91252 | A | 3/2002 |
| JP | 2007-286445 | A | 11/2007 |
| JP | 2011-145714 | A | 7/2011 |

* cited by examiner

*Primary Examiner* — Sophia S Chen
(74) *Attorney, Agent, or Firm* — Canon USA, Inc. IP Division

(57) ABSTRACT

If the length of an adjustment toner image is longer than a circumferential length of a photosensitive member, a voltage which is less than a discharge start voltage is applied while a region of the photosensitive member irradiated with light by an optical sensor passes through a transfer portion. Further, a voltage which is greater than or equal to the discharge start voltage is applied while the photosensitive member rotates at least once after the region of the photosensitive member irradiated with light by the optical sensor passes through the transfer unit. As a result, density unevenness in the adjustment toner image and a potential change in the photosensitive member due to the optical sensor exposing the adjustment toner image are prevented.

6 Claims, 10 Drawing Sheets

IMAGE FORMING APPARATUS FOR OPTICALLY DETECTING AND ADJUSTING A TONER IMAGE

BACKGROUND OF THE INVENTION

1. Field of the Invention

The present invention relates to an image forming apparatus capable of optically detecting a toner image that is formed on an image bearing member for performing adjustment, and adjusting image forming conditions based on the detection result.

2. Description of the Related Art

There is a method performed in an image forming apparatus for processing various recording materials. Such an image forming apparatus includes an intermediate transfer member to which a toner image to be used for performing adjustment (hereinafter, referred to as an "adjustment toner image") is transferred from a photosensitive member. The image forming apparatus then forms the adjustment toner image on the photosensitive member and detects the adjustment toner image on the photosensitive member to adjust the image forming conditions.

A detection unit irradiates the adjustment toner image on the photosensitive member with light to detect the adjustment image. A potential of an irradiated portion on the adjustment toner image which has been irradiated with light thus locally shifts to the positive polarity on the photosensitive member. As a result, if a voltage of positive polarity is further applied when the irradiated portion passes through a transfer unit, the potential of the irradiated portion may be reversed from the negative polarity to the positive polarity, and may have an influence on the image.

Japanese Patent Application Laid-Open No. 2007-286445 discusses a configuration in which an optical sensor that detects the adjustment toner image is positioned opposite to the image bearing member. In such a configuration, when the region irradiated with light on the adjustment toner image in the image bearing member passes through a transfer unit, a voltage of negative polarity and greater than a discharge start voltage is applied to the transfer unit. A trace of the optical sensor irradiating the adjustment toner image with light is thus reduced.

However, a length of the adjustment toner image may be set long to increase accuracy of image density adjustment. In such a case, if the method discussed in Japanese Patent Application Laid-Open No. 2007-286445 is employed, the following problem occurs. More specifically, if a voltage which is higher than the discharge start voltage is applied to the transfer unit, the potential of the photosensitive drum changes. As a result, if the length of the adjustment toner image is longer than a circumferential length of the photosensitive drum, a portion of the adjustment toner image is formed on the photosensitive drum under a different potential, due to discharge in the transfer unit. The density of such a portion thus becomes lower. In other words, the portion of the adjustment toner image is formed under a different condition, so that density unevenness is formed on the adjustment toner image. As a result, it may affect density adjustment using the adjustment toner image.

To solve such a problem, if the length of the adjustment toner image is longer than the circumferential length of the photosensitive drum, it is desirable to set the voltage to be applied to the transfer unit as follows. That is, the voltage to be applied to the transfer unit is of negative polarity and less than the discharge start voltage while the region irradiated with light passes through the transfer unit. However, if the length of the adjustment toner image becomes longer, the optical sensor repeatedly irradiates the photosensitive drum with light to detect the adjustment toner image. The potential of the region in the photosensitive drum which the optical sensor has repeatedly irradiated with light becomes close to a ground potential. If the photosensitive drum is then exposed by a discharging device in such a state, it becomes difficult for photo-carriers generated on the photosensitive drum as a result of exposing by the discharging device to be used in a discharging process. The photo-carriers thus do not immediately disappear, and remain on the photosensitive drum. If the image forming process is performed while the photo-carriers remain on the photosensitive drum, the traces may be generated in subsequent images.

SUMMARY OF THE INVENTION

According to an aspect of the present invention, an image forming apparatus includes a rotatable photosensitive member, an image forming unit configured to form a toner image on the photosensitive member, a transfer member configured to transfer the toner image on the photosensitive member to a transfer material in a transfer portion, an optical sensor disposed downstream of the image forming unit and upstream of the transfer member in a rotating direction of the photosensitive member, and configured to detect an adjustment toner image formed by the image forming unit by irradiating the photosensitive member with light, a voltage application member configured to apply a voltage to the transfer member, an adjustment unit configured to adjust image forming conditions of the image forming unit based on a result of the detection by the optical sensor, and an execution unit configured to execute a voltage application mode for applying, in the case where the adjustment toner image, which is longer than a predetermined value that is greater than or equal to a circumferential length of the photosensitive member in the rotating direction of the photosensitive member, is to be formed, a voltage of a same polarity as a charge polarity of toner and less than a discharge start voltage to the transfer member while a region of the photosensitive member which the optical sensor has irradiated with light passes through the transfer portion, and a voltage of the same polarity as the charge polarity of the toner and greater than or equal to the discharge start voltage to the transfer member while the photosensitive member rotates at least once after the region of the photosensitive member which the optical sensor has irradiated with light passes through the transfer portion.

According to an exemplary embodiment of the present invention, the density unevenness of the adjustment toner image and an effect on an image due to irradiation of light in detecting the adjustment toner image can be prevented.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
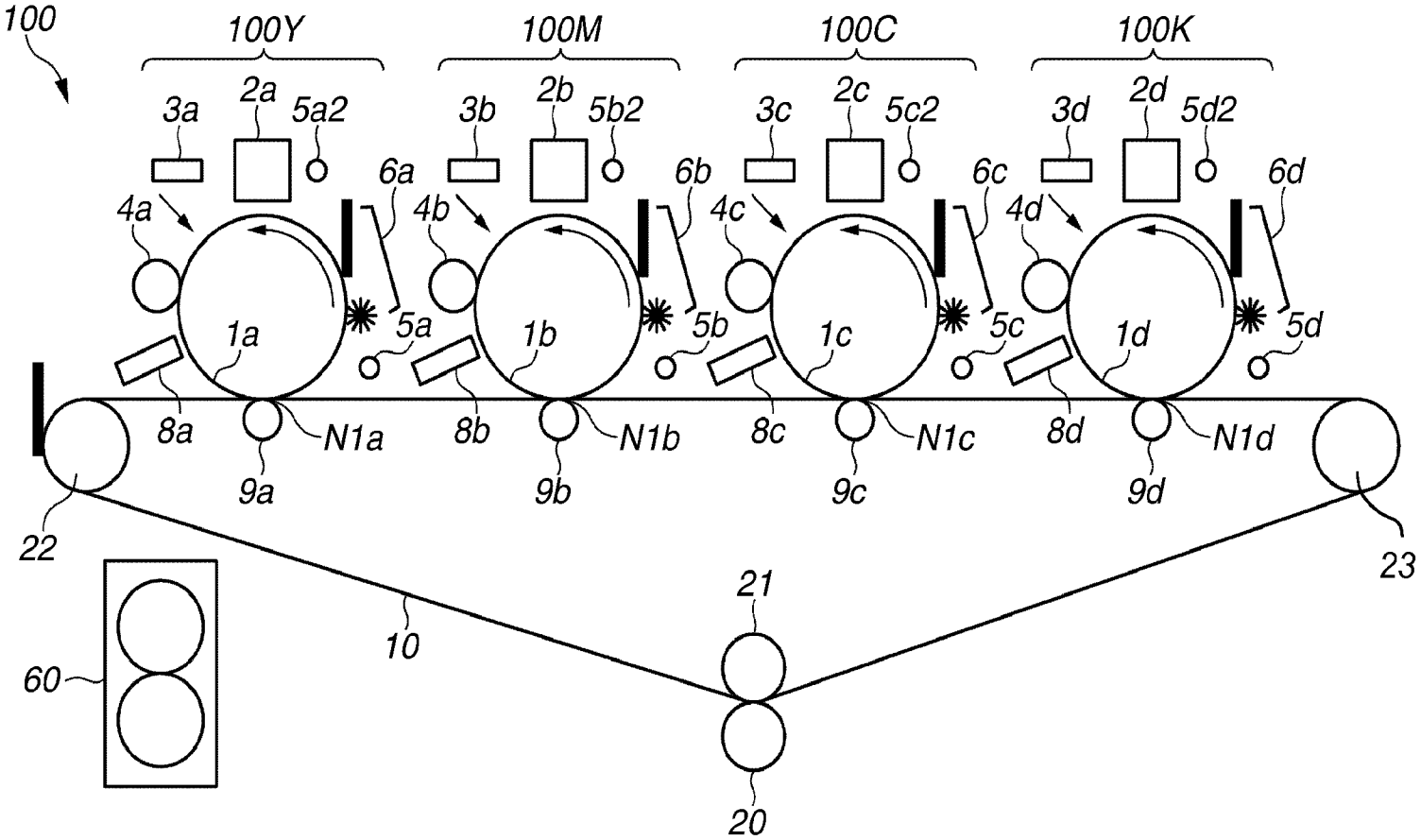
FIG. 1 is a schematic view illustrating a configuration of an image forming apparatus according to an exemplary embodiment of the present invention.

FIG. 1 is a schematic view illustrating a copying machine (an image forming apparatus) 100 according to an exemplary embodiment of the present invention. Referring to FIG. 1, an image forming unit which forms a toner image of each color includes image forming stations 100Y, 100M, 100C, and 100K. The image forming unit thus forms yellow (Y), magenta (M), cyan (C), and black (K) toner images.

In each image forming station, surfaces of photosensitive drums 1*a*, 1*b*, 1*c*, and 1*d* including a photosensitive layer formed by an organic photo conductor (OPC) of a negative charge are uniformly charged (i.e., at −900 V) by corresponding charging devices 2*a*, 2*b*, 2*c*, and 2*d*. Each of the photosensitive drums 1*a*, 1*b*, 1*c*, and 1*d* thus functions as a movable image bearing member that bears the toner image. The photosensitive drums 1*a*, 1*b*, 1*c*, and 1*d* are then exposed by corresponding laser beam scan-exposing devices 3*a*, 3*b*, 3*c*, and 3*d*, and are optically written on. The potential of the exposed photosensitive drum surface changes to −300 V, so that an electrostatic image is formed on the surface of the photosensitive drum surface. Further, developing devices 4*a*, 4*b*, 4*c*, and 4*d* develop the respective electrostatic images on the photosensitive drums 1*a*, 1*b*, 1*c*, and 1*d* to form toner images using toner, i.e., developer. In such a case, a direct current (DC) voltage of −720 V and an alternating current (AC) voltage of 1300 Vpp are applied on the developing devices 4*a*, 4*b*, 4*c*, and 4*d*. The toner image is thus formed on each of the photosensitive drums.

According to the present exemplary embodiment, diameters of the photosensitive drums 1*a*, 1*b*, and 1*c* are 30 mm, and the diameter of the photosensitive drum 1*d* is 84 mm. Different diameters are set to the photosensitive drums are advantageous in terms of saving space, a color/monochrome printing ratio, and product life. Further, according to the present exemplary embodiment, the charging devices 2*a*, 2*b*, and 2*c* include charging rollers, and the charging device 2*d* is a corona charging device.

A transfer voltage is then applied to primary transfer rollers 9*a*, 9*b*, 9*c*, and 9*d*, so that the toner images formed on the photosensitive drums 1*a*, 1*b*, 1*c*, and 1*d* are primarily-transferred to an intermediate transfer belt 10. In other words, the primary transfer rollers 9*a*, 9*b*, 9*c*, and 9*d* function as transfer members that transfer the toner image to the intermediate transfer belt 10, i.e., a transfer material. According to the present exemplary embodiment, a transfer power source 13 applies, as a transfer voltage, a voltage (800 V) of the positive polarity (i.e., a second polarity) that is opposite polarity of the negative polarity (i.e., a first polarity), which is normal charging polarity of the toner. The transfer power source 13 thus functions as a voltage application unit which applies the transfer voltage to the transfer member.

Each of the primary transfer rollers 9*a*, 9*b*, 9*c*, and 9*d* press each of the photosensitive drums 1*a*, 1*b*, 1*c*, and 1*d* via the intermediate transfer belt 10, to respectively form primary transfer nips N1*a*, N1*b*, N1*c*, and N1*d* at which the toner image is transferred. The primary transfer rollers 9*a*, 9*b*, 9*c*, and 9*d* whose resistance value, when applying 2 kV, is $1\times10^2$ to $1\times10^8$ under a measuring environment in which the temperature is 23° C. and humidity is 50% may be used.

Discharging devices 5*a*, 5*b*, 5*c*, and 5*d* uniformly expose and discharge the surfaces of the photosensitive drums 1*a*, 1*b*, 1*c*, and 1*d* after primary transfer is performed. Cleaning devices 6*a*, 6*b*, 6*c*, and 6*d* then clean the surfaces of the photosensitive drums 1*a*, 1*b*, 1*c*, and 1*d*, and discharging devices 5*a*2, 5*b*2, 5*c*2, and 5*d*2 further discharge the surfaces of the photosensitive drums 1*a*, 1*b*, 1*c*, and 1*d*.

The intermediate transfer belt 10 stretched by stretching rollers 21, 22, and 23 bears and conveys the toner images. Volume resistivity of the intermediate transfer belt 10 is adjusted to $1\times10^9$ to $1\times10^{11}\Omega\cdot$cm, and surface resistivity of the intermediate transfer belt 10 is adjusted to $1\times10^{11}$ to $1\times10^{13}\Omega\cdot cm^2$.

On the other hand, a recording material is stored in a cassette (not illustrated). The recording material is supplied synchronously as the toner image on the intermediate transfer belt 10 is conveyed.

A secondary transfer roller 20, which is a transfer member that forms a secondary transfer nip for transferring the toner image to the recording material, is disposed opposite to the stretching roller 21. The secondary transfer roller 20 is connected to a secondary transfer high voltage power source whose supplying bias is variable. When the recording material is conveyed to the secondary transfer nip, the transfer voltage of opposite polarity to the toner is applied to the secondary transfer roller 20, and the toner image on the intermediate transfer belt 10 is collectively electrostatic-transferred to the recording material.

After the toner image is transferred, the recording material is conveyed to a fixing device 60 which fixes the toner image on the recording material by heating and pressing. After the toner image is fixed, the recording material is discharged outside the apparatus.

Figure 2:
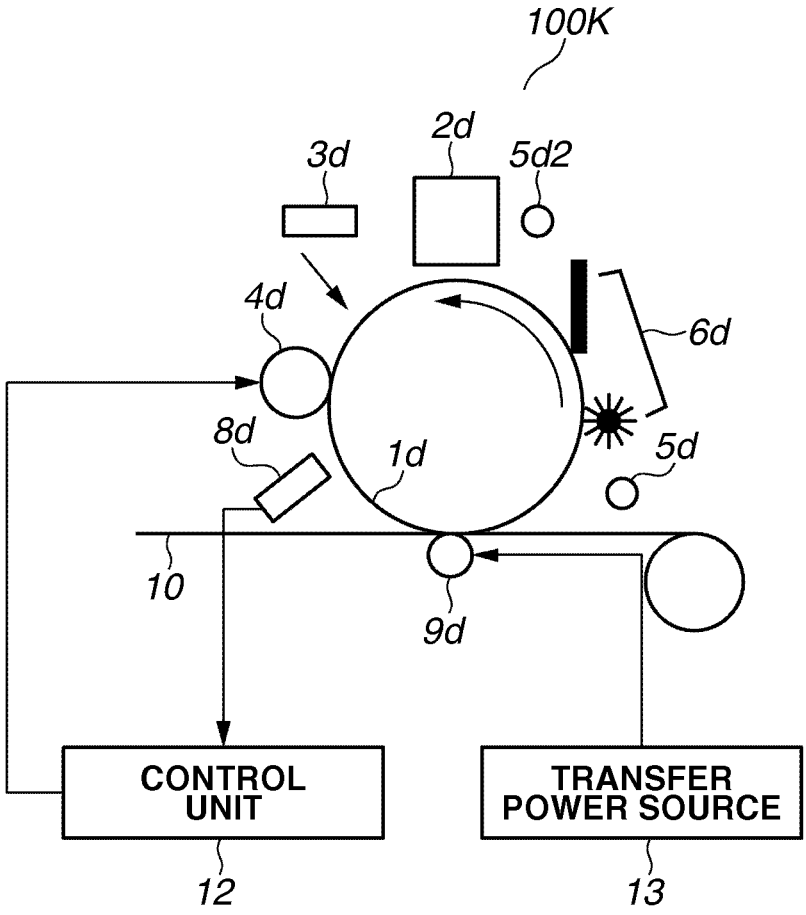
FIG. 2 is a schematic view illustrating a configuration of components surrounding a photosensitive drum according to the exemplary embodiment.

A control unit 12 illustrated in FIG. 2 is a general computer control apparatus which is programmed and includes a calculation function. The control unit 12 integrally controls each unit in the image forming apparatus 100 and forms the image on the recording material. The control unit 12 also functions as a control unit for controlling the transfer power source 13.

According to the present exemplary embodiment, the control unit 12 functions as an execution unit capable of executing a monochrome image forming mode and a full color image forming mode. The color image forming mode is executed while the photosensitive drums 1*a*, 1*b*, 1*c*, and 1*d* are contacting the intermediate transfer belt 10. The monochrome image forming mode is executed while the photosensitive drum 1*a* contacts the intermediate transfer belt 10, and the photosensitive drums 1*b*, 1*c*, and 1*d* are separated from the intermediate transfer belt 10. The control unit 12 functions as the execution unit for executing the above-described modes.

According to the present exemplary embodiment, to detect the adjustment toner image to adjust the image forming conditions, optical sensors 8*a*, 8*b*, 8*c*, and 8*d* are respectively disposed opposite to the photosensitive drums 1*a*, 1*b*, 1*c*, and 1*d*. Each of the optical sensors 8*a*, 8*b*, 8*c*, and 8*d* is disposed downstream of each of the developing devices 4*a*, 4*b*, 4*c*, and 4*d*, and upstream of each of the transfer portions N1*a*, N1*b*, N1*c*, and N1*d* in a moving direction of the photosensitive drums 1*a*, 1*b*, 1*c*, and 1*d*. When the adjustment toner images of Y, M, C, and K colors pass through the corresponding optical sensors 8*a*, 8*b*, 8*c*, and 8*d*, voltage signals according to the density of the adjustment toner images are output as the detection result. The control unit 12 then determines the densities of adjustment toner images 18 of Y, M, C, and K colors based on the voltage signals, to control the density of the developer or the high voltage in the corresponding developing devices 4*a*, 4*b*, 4*c*, and 4*d*.

Figure 3:
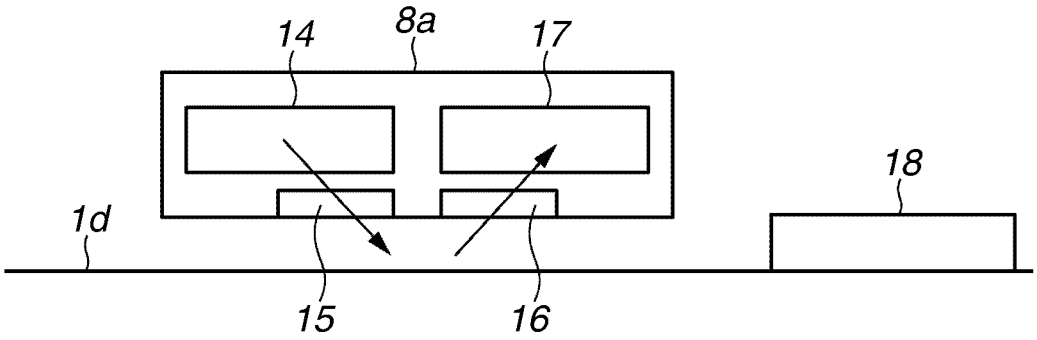
FIG. 3 illustrates exposure by an optical sensor.

Configurations of the optical sensors 8*a*, 8*b*, 8*c*, and 8*d* will be described below with reference to FIG. 3. The configurations of the optical sensors 8*a*, 8*b*, 8*c*, and 8*d* are the same. Each of the optical sensors 8*a*, 8*b*, 8*c*, and 8*d* includes an illumination window 15, a light-emitting diode (LED) 14 as a light emitting portion that emits light, a sensor window 16, and a photodiode 17 as a light receiving unit that receives reflected light.

According to the present exemplary embodiment, a directional LED manufactured by Stanley Corporation, having a central wavelength of 880 nm (a half-value width of 50 nm) is used. The width of the irradiated light in a width direction perpendicular to the direction in which the intermediate transfer member moves is 7 mm. The amount of irradiation light is set using an optical power meter manufactured by ADC Corporation, so that a stationary light amount value becomes 100 μW. The above-described values are not limitations.

According to the present exemplary embodiment, the adjustment toner image is formed in a space between images when the image forming process is performed, and during pre-rotation before starting the image forming process. When the adjustment toner image is formed in the space between the images, the length of the adjustment toner image is set short to prioritize productivity. On the other hand, if the adjustment toner image is formed during the pre-rotation, the length of the adjustment toner image is set long to prioritize adjustment accuracy. When the adjustment toner image is formed in the space between the images, the length of the adjustment toner image for each color is 200 mm in the moving direction of the intermediate transfer belt 10. When the adjustment toner image is formed during the pre-rotation, the length of the adjustment toner image for each color is 912 mm. The circumferential length of each of the photosensitive drums 1*a*, 1*b*, 1*c*, and 1*d* is 264 mm. In other words, the length of the adjustment toner image in the space between the images is less than or equal to the circumferential length of the photosensitive drum in the moving direction of the photosensitive drum 1*a*, 1*b*, 1*c*, or 1*d*. In contrast, the length of the adjustment toner image formed during the pre-rotation is longer than the circumferential length of the photosensitive drum 1*a*, 1*b*, 1*c*, or 1*d*.

The width of the adjustment toner image for each color is approximately 2 cm in the width direction perpendicular to the moving direction of the intermediate transfer belt 10 in both cases where the adjustment toner image is formed between the images and during the pre-rotation. Further, the length of the adjustment toner image is the length from a leading end to a rear end of the adjustment toner image in the rotating direction of the photosensitive drum 1*a*, 1*b*, 1*c*, or 1*d*. The adjustment toner image may be formed of a plurality of regions divided by a region in which there is no toner image, such as the images of each gray level in the adjustment toner image for performing gray level correction. The length of such an adjustment toner image is the length including all of the regions, in which there is no toner image and the plurality of regions.

When a full-color image is to be formed, the adjustment toner image is formed in the space between the images between the recording materials. Setting of the voltage to be applied to the primary transfer roller 9*a*, 9*b*, 9*c* or 9*d* when forming the full color image on the recording material will be described below.

Figure 5:
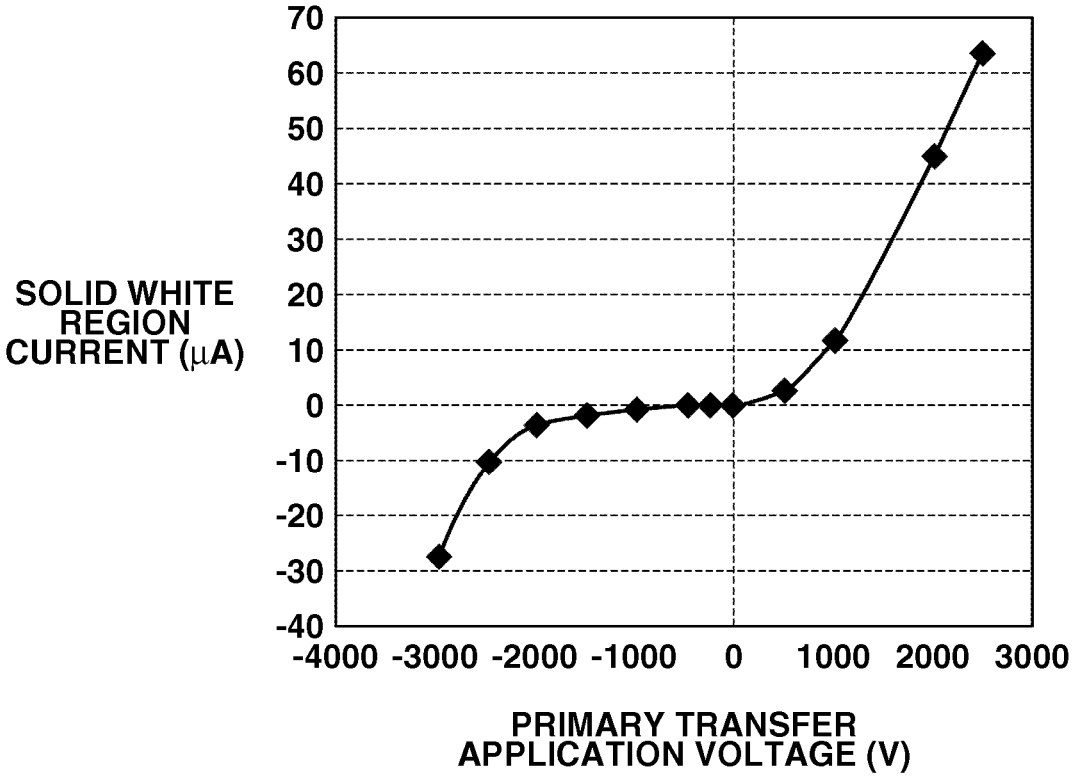
FIG. 5 is a graph illustrating a solid white region current against a transfer application voltage.

FIG. 5 is a graph illustrating the relation between a primary transfer voltage and a solid white region current under the environment in which the temperature is 23° C. and humidity is 50%. Referring to FIG. 5, according to the present exemplary embodiment, when the toner image to be formed on the recording material passes through the primary transfer nip N1*a*, N1*b*, N1*c* or N1*d*, the transfer voltage of +800 V for transferring the toner image is applied to the primary transfer rollers 9*a*, 9*b*, 9*c*, and 9*d*.

The voltage setting of the primary transfer roller 9*a*, 9*b*, 9*c*, or 9*d* when the adjustment toner images 18 of Y, M, C, and K colors pass through the corresponding primary transfer nips N1*a*, N1*b*, N1*c*, and N1*d* will be described below.

Figure 4:
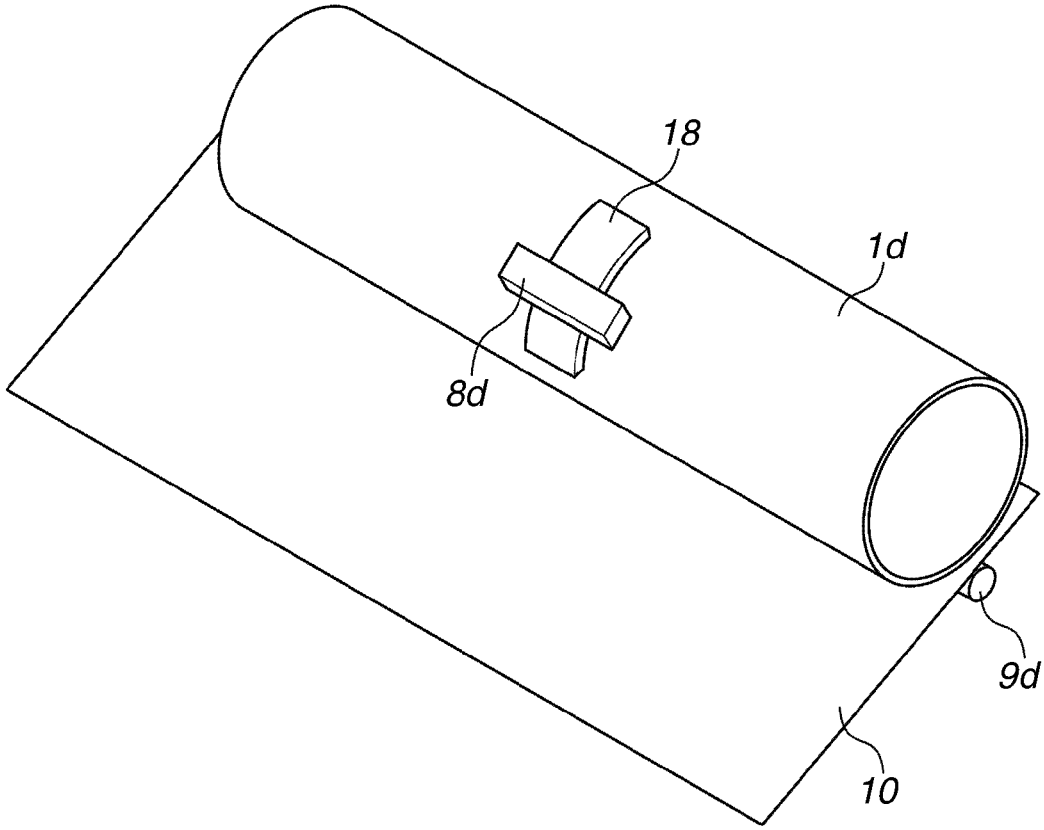
FIG. 4 is a birds-eye view illustrating an adjustment toner image entering a transfer portion.

According to the present exemplary embodiment, the adjustment toner image, whose length is shorter than or equal to the circumferential length of the photosensitive drum 1*a*, 1*b*, 1*c*, or 1*d*, is formed between the images. When the adjustment toner images 18 of Y, M, C, and K colors respectively pass through the corresponding primary transfer nips N1*a*, N1*b*, N1*c*, and N1*d*, the voltage of negative polarity (i.e., the first polarity which is of the same polarity as the toner) and greater than or equal to the discharge start voltage is applied to the corresponding primary transfer roller 9*a*, 9*b*, 9*c*, or 9*d*. The "discharge start" indicates that discharge of the atmosphere is started in the space between the primary transfer roller 9*a*, 9*b*, 9*c*, or 9*d* and the photosensitive drum 1*a*, 1*b*, 1*c*, or 1*d* at a position in which a distance and an electric field satisfy a discharge condition of Paschen's law. Further, the discharge start voltage is the voltage applied to the primary transfer roller 9*a*, 9*b*, 9*c*, or 9*d* when discharge starts with respect to the photosensitive drum 1*a*, 1*b*, 1*c*, or 1*d* of a predetermined potential. As a result, the effect on the subsequent image is prevented even when the trace of light irradiation by the optical sensor 8*d* is generated as illustrated in FIG. 4.

Control of transfer high voltage when forming the adjustment toner image in the pre-rotation will be described below. In the pre-rotation, the length of the adjustment toner image in the moving direction of the intermediate transfer belt 10 is set long to prioritize the density adjustment accuracy, unlike forming the adjustment image between the images.

If the method discussed in Japanese Patent Application Laid-Open No. 2007-286445 is used in such a case, the following problem occurs. If a voltage higher than the discharge start voltage is applied to the transfer portion, the potential of the photosensitive drum 1*a*, 1*b*, 1*c*, or 1*d* changes. As a result, if the adjustment toner image is longer than the circumferential length of the drum 1*a*, 1*b*, 1*c*, or 1*d*, a portion of the adjustment toner image is formed at a different potential of the photosensitive drum 1*a*, 1*b*, 1*c*, or 1*d* due to the discharge at the transfer portion. The density thus decreases. That is, since a portion of the adjustment toner image is formed under a different condition, the density unevenness may be generated in the adjustment toner image, so that density adjustment using the adjustment toner image may be affected. To solve such a problem, when the adjustment toner image is longer than the circumferential length of the drum 1*a*, 1*b*, 1*c*, or 1*d*, it is necessary to set the voltage applied to the transfer portion to be of negative polarity and less than the discharge start voltage while the region irradiated by light passes through the transfer portion.

Further, if the polarity of the photosensitive drum 1*a*, 1*b*, 1*c*, or 1*d* is reversed at the transfer portion, the trace of the exposure remains on the subsequent images. Since the potential does not decrease even when the discharging device irradiates with light the photosensitive drum 1*a*, 1*b*, 1*c*, or 1*d* whose potential has been reversed, the trace of the potential remains, and the potential does not become uniform in the subsequent charging process. In such a case, if the voltage of negative polarity and less than the discharge start voltage is applied to the transfer portion, the polarity of the photosensitive drum 1*a*, 1*b*, 1*c*, or 1*d* is prevented from being charged to the positive polarity in the transfer portion. The exposure trace can thus be prevented from remaining on the next image due to the reversal of the polarity of the photosensitive drum 1*a*, 1*b*, 1*c*, or 1*d*.

However, if the length of the adjustment toner image becomes long, the optical sensor 8*a*, 8*b*, 8*c*, or 8*d* repeatedly irradiates the photosensitive drum 1*a*, 1*b*, 1*c*, or 1*d* with light. In such a case, the potential of the photosensitive drum 1*a*, 1*b*, 1*c*, or 1*d* becomes close to the ground potential. If the discharging device further exposes the photosensitive drum surface, which has near the ground potential due to light irradiation of the optical sensor 8*a*, 8*b*, 8*c*, or 8*d*, the photo-carriers formed on the photosensitive drum 1*a*, 1*b*, 1*c*, or 1*d* by exposure of the discharging device become difficult to be used in the discharging process. The photo-carriers formed on the photosensitive drum 1*a*, 1*b*, 1*c*, or 1*d* thus do not disappear by exposure of the discharging device, and remain on the photosensitive drum 1*a*, 1*b*, 1*c*, or 1*d*. If the photo-carriers remain on the photosensitive drum 1*a*, 1*b*, 1*c*, or 1*d*, electrical characteristics thereof change, so that development and transfer processes are damaged. In other words, long-term exposure may form the traces on the image by performing the image forming process while the photo-carriers remain on the photosensitive drum 1*a*, 1*b*, 1*c*, or 1*d*.

A method is thus desired for preventing image failure from occurring due to the remaining photo-carriers as a result of the long-term exposure, while reducing the density unevenness of the adjustment toner image and the exposure traces caused by the potential reversal of the photosensitive drum 1*a*, 1*b*, 1*c*, or 1*d*. Such a method prevents the image failure from occurring even when the length of the adjustment toner image is longer than the length of the photosensitive drum 1*a*, 1*b*, 1*c*, or 1*d* for increasing the adjustment accuracy of the image density in detecting the adjustment toner image on the photosensitive drum 1*a*, 1*b*, 1*c*, or 1*d*.

According to the present exemplary embodiment, in the pre-rotation, when the region the optical sensor 8*a*, 8*b*, 8*c*, or 8*d* have irradiated with light passes through the transfer portion, a voltage of negative polarity (i.e., the first polarity) and less than the discharge start voltage is applied to the primary transfer roller 9*a*, 9*b*, 9*c*, or 9*d*. As a result, the density unevenness in the adjustment toner image and generation of the trace on the subsequent image due to the potential reversal of the photosensitive drum surface (i.e., exposure trace) can be prevented. Further, a voltage application mode for applying to the primary transfer roller 9*a*, 9*b*, 9*c*, or 9*d* a voltage of negative polarity (i.e., the first polarity) and greater than or equal to the discharge start voltage is executed while the photosensitive drum 1*a*, 1*b*, 1*c*, or 1*d* rotate at least once after the region the optical sensor 8*a*, 8*b*, 8*c*, or 8*d* have irradiated with light passes through the transfer portion. The trace on the subsequent images due to the photo-carriers remaining on the photosensitive drum 1*a*, 1*b*, 1*c*, or 1*d* by the long-term exposure (i.e., an effect due to the long-term exposure) can be prevented from being generated. The control unit 12 functions as the execution unit that executes the voltage application mode.

Figure 6:
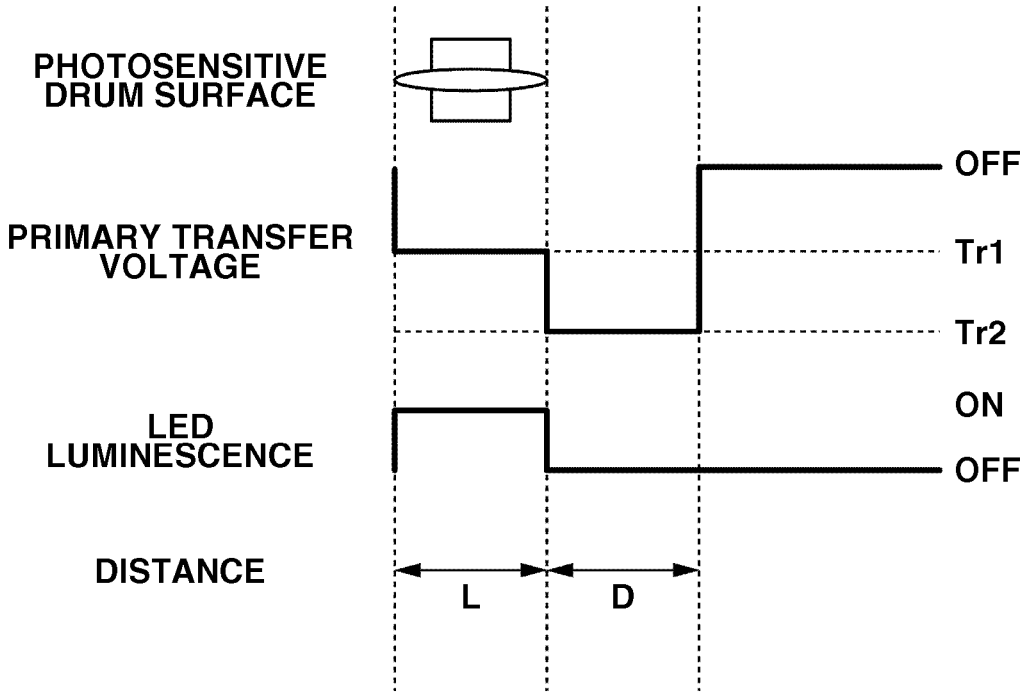
FIG. 6 is a diagram illustrating transfer voltage control according to the exemplary embodiment.

The present exemplary embodiment will be described in more detail below. FIG. 6 illustrates the image forming conditions for confirming the exposure trace and the negative effect of the long-term exposure caused by the optical sensor 8 disposed opposite the photosensitive drum 1. According to the present exemplary embodiment, a circumferential length D of the photosensitive drum 1*d* is 264 mm. A length L of the adjustment toner images 18 of Y, M, C, and K colors in the moving direction of the intermediate transfer belt 10 is 912 mm.

A voltage Tr1 (i.e., a first voltage) is applied to the corresponding primary transfer rollers 9*a*, 9*b*, 9*c*, and 9*d* while the adjustment toner images 18 of Y, M, C, and K colors pass through the corresponding primary transfer portion from the leading end to the rear end. A voltage Tr2 (i.e., a second voltage) is applied to the primary transfer rollers 9*a*, 9*b*, 9*c*, and 9*d* while the photosensitive drums 1*a*, 1*b*, 1*c*, and 1*d* rotates once after the rear end of the corresponding adjustment toner images 18Y, 18M, 18C, and 18K passes through the corresponding primary transfer nips N1*a*, N1*b*, N1*c* and N1*d*. The conditions of Tr1 and Tr2 are changed to confirm whether the trace on the subsequent image (i.e., the exposure trace) is generated due to the potential reversal of the photosensitive drum surface, and the traces on the subsequent images (i.e., the negative effect of the long-term exposure) are generated due to the remaining photo-carriers as a result of the long-term exposure. Table 1 illustrates the results of the confirmation.

TABLE 1

Results of confirming effect due to transfer voltage conditions

| Tr1 | Tr2 | Exposure trace | Negative effect of Long-term exposure |
|---|---|---|---|
| 200 | 200 | yes | yes |
| | 100 | yes | yes |
| | 0 | yes | yes |
| | −500 | yes | yes |
| | −1000 | yes | yes |
| | −1500 | yes | no |
| | −2000 | yes | no |
| 0 | 200 | yes | yes |
| | 100 | yes | yes |
| | 0 | yes | yes |
| | −500 | yes | yes |
| | −1000 | yes | yes |
| | −1500 | yes | no |
| | −2000 | yes | no |
| −500 | 200 | no | yes |
| | 100 | no | yes |
| | 0 | no | yes |
| | −500 | no | yes |
| | −1000 | no | yes |
| | −1500 | no | no |
| | −2000 | no | no |
| −1000 | 200 | no | yes |
| | 100 | no | yes |
| | 0 | no | yes |
| | −500 | no | yes |
| | −1000 | no | yes |
| | −1500 | no | no |

TABLE 1-continued

| Results of confirming effect due to transfer voltage conditions | | | |
|---|---|---|---|
| Tr1 | Tr2 | Exposure trace | Negative effect of Long-term exposure |
| | −2000 | no | no |
| −1500 | 200 | no | yes |
| | 100 | no | yes |
| | 0 | no | yes |
| | −500 | no | yes |
| | −1000 | no | yes |
| | −1500 | no | no |
| | −2000 | no | no |
| −2000 | 200 | no | yes |
| | 100 | no | yes |
| | 0 | no | yes |
| | −500 | no | yes |
| | −1000 | no | yes |
| | −1500 | no | no |
| | −2000 | no | no |

As illustrated in Table 1, it is desirable to set the voltage Tr1 (i.e., a first voltage) to be applied when the adjustment toner image on the photosensitive drum 1*a*, 1*b*, 1*c*, or 1*d* passes through the primary transfer nip N1*a*, N1*b*, N1*c* or N1*d* as follows to reduce generation of the exposure trace due to reversal of the surface potential of the photosensitive drum 1*a*, 1*b*, 1*c*, or 1*d*. It is desirable to set the voltage Tr1 to be of negative polarity (i.e., the first polarity) and less than the discharge start voltage Tr0. Further, it is desirable to set Tr2 (i.e., the second voltage) as follows to prevent the traces to be generated in the subsequent images caused by the remaining photo-carriers due to the negative effect of the long-term exposure. It is desirable to set Tr2 to be of negative polarity (i.e., the first polarity) and greater than or equal to the discharge start voltage Tr0 (between −1000 V to −1500 V). Such settings will be described in detail with reference to FIGS. 7, 8, 9, and 10.

Figure 7:
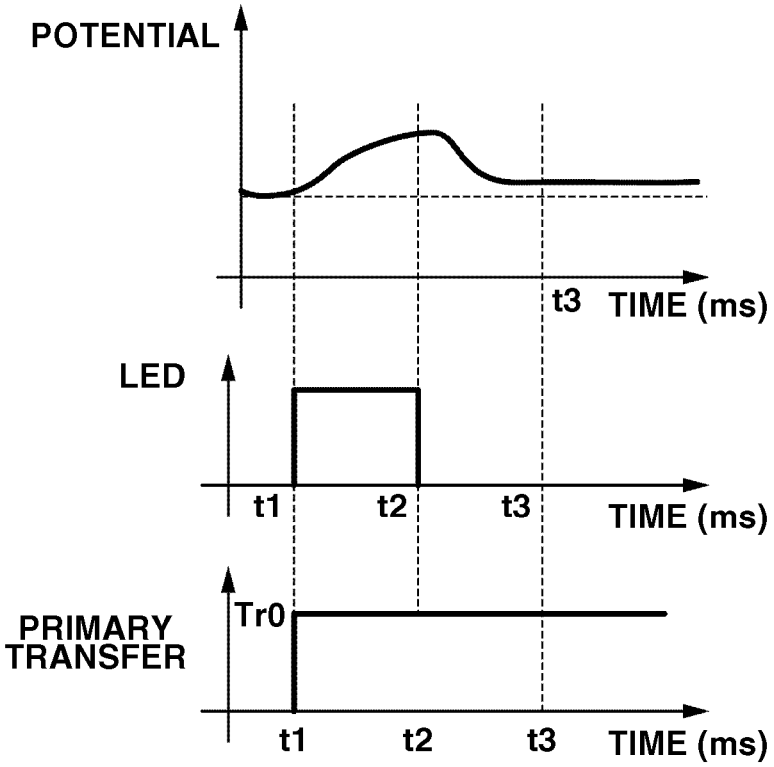
FIG.7 PRIOR ART
FIG. 7 is a diagram illustrating a voltage change with respect to time in a conventional example.

FIG. 7 illustrates a potential transition in the case where the transfer voltage of positive polarity is continuously applied to form the image while the adjustment toner image is passing through the primary transfer nip N1*a*, N1*b*, N1*c* or N1*d* as well as after the adjustment toner image passes through the primary transfer nip N1*a*, N1*b*, N1*c* or N1*d*. Time is indicated on a horizontal axis. A dark potential on the photosensitive drum 1*a*, 1*b*, 1*c*, or 1*d*, on/off of the LED, and the voltage applied to the primary transfer roller 9*a*, 9*b*, 9*c*, or 9*d* are indicated on a vertical axis, in which an upward direction with respect to the diagram indicates the positive direction, and a downward direction indicates the negative direction. The middle graph illustrated in FIG. 7 indicates the state in which the adjustment toner image is passing through the optical sensor unit, and the bottom graph indicates the state in which the region the LED has irradiated is passing through the primary transfer nip N1*a*, N1*b*, N1*c* or N1*d*. The top graph indicates the potential after the region the LED has irradiated passes through the primary transfer nip N1*a*, N1*b*, N1*c* or N1*d* and is charged by the charging roller. A horizontal broken line indicates a target potential. A charging period between t1 and t2 corresponds to the region the LED has irradiated. The period between t2 and t3 is the range in which the photosensitive drum 1*a*, 1*b*, 1*c*, or 1*d* rotates once after the irradiated region which has been irradiated by the optical sensor 8 (i.e., corresponding to the region on which the adjustment toner image is formed) passes through the primary transfer nip N1*a*, N1*b*, N1*c* or N1*d*.

In such a case, when the irradiated region passes through the primary transfer nip N1*a*, N1*b*, N1*c* or N1*d*, the transfer voltage of positive polarity is applied to charge the irradiated region in the positive polarity by a large charging amount. As a result, the potential of the irradiated region, which has been irradiated by the LED with the optical sensor 8, greatly changes towards the positive polarity, so that the potential is reversed from the negative polarity to the positive polarity. The image failure (i.e., the exposure trace) due to the reversal of the photosensitive drum polarity thus occurs. Further, the photo-carriers generated in the region, which the optical sensor 8 has repeatedly irradiated with light, remain on the photosensitive drum 1*a*, 1*b*, 1*c*, or 1*d* without immediately disappearing after the optical sensor 8 irradiates the photosensitive drum 1*a*, 1*b*, 1*c*, or 1*d*. As a result, the remaining photo-carriers due to the long-term exposure causes the image failure. Furthermore, the potential of the photosensitive drum 1*a*, 1*b*, 1*c*, or 1*d* does not return to the dark potential level (i.e., the horizontal broken line illustrated in FIG. 7) before being irradiated by the optical sensor 8, due to the effect of the photo-carriers and charging performed in the transfer portion.

Figure 8:
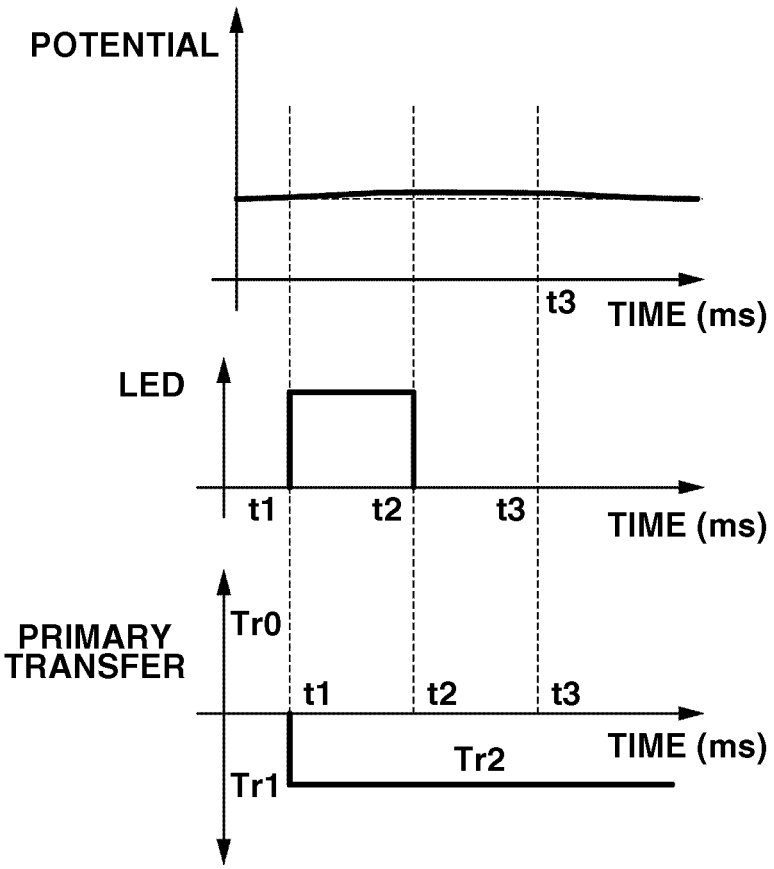
FIG. 8 is a diagram illustrating a voltage change with respect to time in a comparison example.

FIG. 8 illustrates a potential transition in the case where Tr1 and Tr2 are both set to a voltage of negative polarity (i.e., the first polarity) and less than the discharge start voltage.

In such a case, when the irradiated region passes through the primary transfer nip N1*a*, N1*b*, N1*c* or N1*d*, the voltage of negative polarity and less than the discharge start voltage is applied to the primary transfer roller 9*a*, 9*b*, 9*c*, or 9*d*. The photosensitive drum surface is thus prevented from being charged to the positive polarity at the primary transfer nip N1*a*, N1*b*, N1*c* or N1*d*. As a result, the exposure trace, which is caused by the reversal of the potential in the irradiate region to the positive polarity, is prevented from being generated. Further, the potential change in the photosensitive drum 1*a*, 1*b*, 1*c*, or 1*d* at the transfer portion is small, so that, even when the length of the adjustment toner image is longer than the circumferential length of the photosensitive drum 1*a*, 1*b*, 1*c*, or 1*d*, the entire adjustment toner image is formed under the same condition. In other words, the density unevenness in the adjustment toner image is prevented.

However, the potential of the photosensitive drum 1*a*, 1*b*, 1*c*, or 1*d* in the region, which has been repeatedly irradiated with light by the optical sensor 8, is close to the ground potential. It thus becomes difficult for the photo-carriers generated on the photosensitive drum 1*a*, 1*b*, 1*c*, or 1*d* by the discharging device 5 to be used in discharging the region, which has been repeatedly irradiated. As a result, the photo-carriers do not immediately disappear and remain on the photosensitive drum 1*a*, 1*b*, 1*c*, or 1*d*. Since resistance characteristics of the photosensitive drum 1*a*, 1*b*, 1*c*, or 1*d* change in the region in which the photo-carriers remain, it damages the developing and transfer processes. The image failure caused by the photo-carriers remaining on the photosensitive drum 1*a*, 1*b*, 1*c*, or 1*d* thus occurs due to the negative effect of the long-term exposure. Further, since the photo-carriers remain on the photosensitive drum 1*a*, 1*b*, 1*c*, or 1*d*, it takes time for the potential to return to the original dark potential level.

Figure 9:
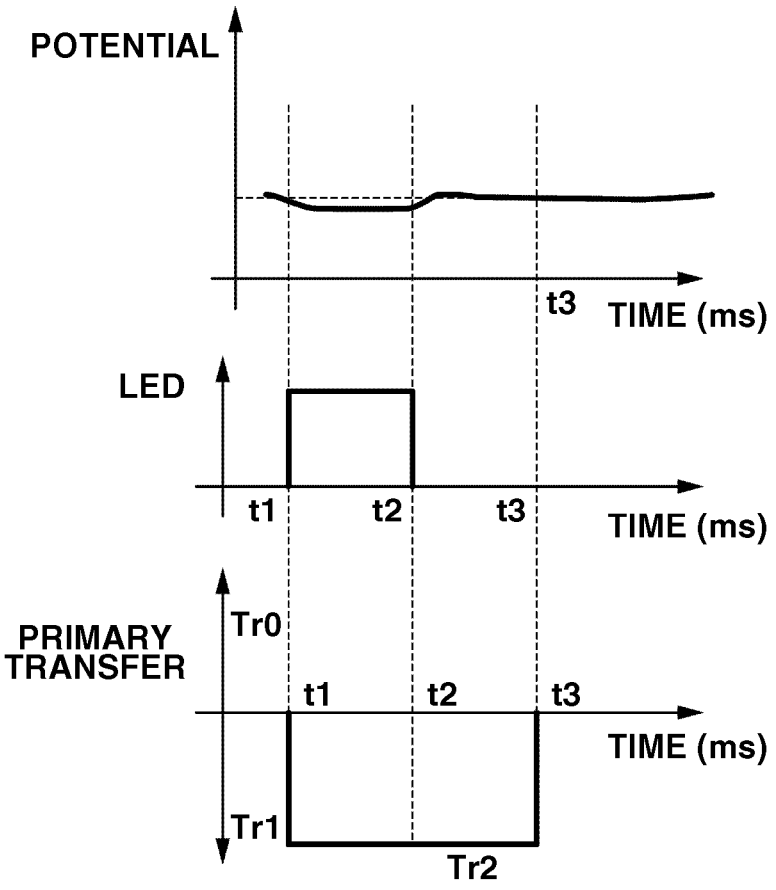
FIG. 9 is a diagram illustrating a voltage change with respect to time in a comparison example.

FIG. 9 illustrates a potential transition in the case where the voltages Tr1 and Tr2 are both set to a voltage of negative polarity (i.e., the first polarity) and greater than or equal to the discharge start voltage.

In such a case, when the irradiated region passes through the primary transfer nip N1*a*, N1*b*, N1*c* or N1*d*, the discharge occurs between the photosensitive drum 1*a*, 1*b*, 1*c*, or 1*d* and the intermediate transfer belt 10, so that the potential of the photosensitive drum 1*a*, 1*b*, 1*c*, or 1*d* is greatly charged in the negative polarity. As a result, if the length of the adjustment toner image is longer than the circumferential length of the photosensitive drum 1*a*, 1*b*, 1*c*, or 1*d*, the dark potential in forming the leading end of the adjustment toner image and the dark potential in forming the rear end of the adjustment toner image become different. Since the conditions for forming the adjustment toner image become non-uniform, the density unevenness is generated in the adjustment toner image.

If the length of the adjustment toner image is longer than the circumferential length of the photosensitive drum 1*a*, 1*b*, 1*c*, or 1*d*, it becomes difficult to appropriately adjust the image forming condition using the adjustment toner image. On the other hand, since the surface of the photosensitive drum 1*a*, 1*b*, 1*c*, or 1*d* is re-charged to the negative polarity at the primary transfer nip N1*a*, N1*b*, N1*c* or N1*d*, the potential of the photosensitive drum 1*a*, 1*b*, 1*c*, or 1*d* is prevented from being reversed to the positive polarity. Further, the voltage, which is greater than or equal to the discharge start voltage, is applied at the primary transfer nip N1*a*, N1*b*, N1*c* or N1*d*, so that movement of the photo-carriers in the photosensitive drum 1*a*, 1*b*, 1*c*, or 1*d* is accelerated by the discharge in the primary transfer nip N1*a*, N1*b*, N1*c* or N1*d*. As a result, the photo-carriers remaining on the photosensitive drum 1*a*, 1*b*, 1*c*, or 1*d* disappear at a higher speed, so that the image traces caused by the photo-carriers due to the long-term exposure are prevented from being generated on the subsequent images.

Figure 10:
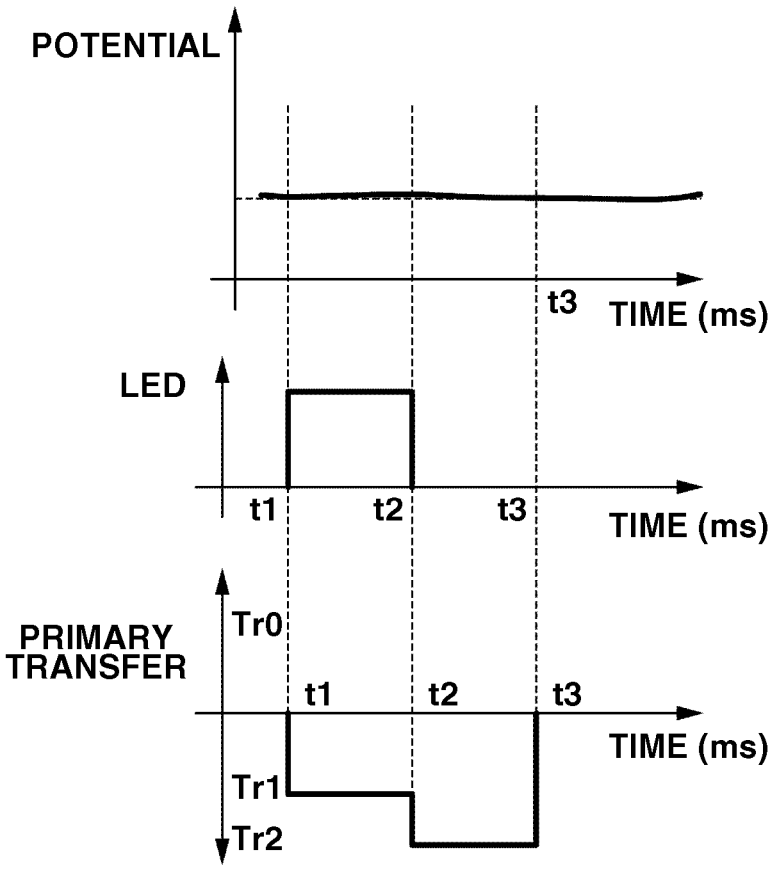
FIG. 10 is a diagram illustrating a voltage change with respect to time according to the exemplary embodiment.

FIG. 10 illustrates the settings of voltages Tr1 and Tr2 according to the present exemplary embodiment based on the above-described results illustrated in FIGS. 7, 8, and 9. More specifically, according to the present exemplary embodiment, the control unit 12 sets Tr1, i.e., the first voltage, to a voltage of negative polarity (i.e., the first polarity) and less than the discharge start voltage. Further, the control unit 12 sets Tr2, i.e., the second voltage, to a voltage of negative polarity (i.e., the first polarity) and greater than or equal to the discharge start voltage.

That is, when the region irradiated by the optical sensor 8 passes through the primary transfer nip N1*a*, N1*b*, N1*c* or N1*d*, the control unit 12 applies to the primary transfer roller 9*a*, 9*b*, 9*c*, or 9*d* the voltage of negative polarity (i.e., the first polarity) and less than the discharge start voltage. According to the present exemplary embodiment, the potential of the photosensitive drum 1*a*, 1*b*, 1*c*, or 1*d* after passing through the primary transfer nip N1*a*, N1*b*, N1*c* or N1*d* is set between −900 V and −300 V. However, it is not limited thereto. As a result, even when the adjustment toner image is longer than the circumferential length of the photosensitive drum 1*a*, 1*b*, 1*c*, or 1*d*, the density unevenness of the adjustment toner image and generation of the exposure trace due to reversal of the photosensitive drum potential are prevented.

Further, while the photosensitive drum 1*a*, 1*b*, 1*c*, or 1*d* rotates once after the region irradiated by the optical sensor 8 passes through the primary transfer nip N1*a*, N1*b*, N1*c* or N1*d*, the control unit 12 applies to the primary transfer roller 9*a*, 9*b*, 9*c*, or 9*d* a voltage of negative polarity (i.e., the first polarity) and greater than or equal to the discharge start voltage. More specifically, since it is difficult to use the photo-carriers generated by exposure of the discharging device in discharging the region which has been repeatedly irradiated, the photo-carriers remain on the photosensitive drum 1*a*, 1*b*, 1*c*, or 1*d*. If the photo-carriers remaining on the photosensitive drum 1*a*, 1*b*, 1*c*, or 1*d* do not immediately disappear, the image failure occurs in the subsequent images. However, if the voltage which is greater than or equal to the discharge start voltage is applied, charge transfer of the photo-carriers remaining on the photosensitive drum 1*a*, 1*b*, 1*c*, or 1*d* is accelerated due to the discharge in the primary transfer nip N1*a*, N1*b*, N1*c* or N1*d*. As a result, the photo-carriers disappear at higher speed, and the image failure in the subsequent images caused by the photo-carriers remaining on the photosensitive drum 1*a*, 1*b*, 1*c*, or 1*d* due to the long-term exposure is prevented. According to the present exemplary embodiment, the control unit 12 applies to the primary transfer roller 9*a*, 9*b*, 9*c*, or 9*d* the second voltage Tr2 while the photosensitive drum 1*a*, 1*b*, 1*c*, or 1*d* rotates once. However, it is not limited thereto. The voltage Tr2 may be applied to the primary transfer roller 9*a*, 9*b*, 9*c*, or 9*d* longer than the photosensitive drum 1*a*, 1*b*, 1*c*, or 1*d* rotates at least once.

Furthermore, the present exemplary embodiment may be applied to a case where the adjustment toner images 18 of Y, M, C, and K colors are formed in the width direction at positions in which there is no overlap. Only the adjustment toner image 18 of K color is then detected on the photosensitive drum 1*d*, and the adjustment toner images 18 of Y, M, and C colors are detected on the intermediate transfer belt 10. In such a case, while the adjustment toner image 18 of K color passes through the nip N1*d*, the adjustment toner images 18 of Y, M, and C colors pass through the nip N1*d* from the upstream at the same time. Since the first voltage Tr1 of negative polarity (i.e., the first polarity) and less than the discharge start voltage (e.g., −500 V) is applied to the primary transfer roller 9*d* in such a case, the density unevenness is prevented from being generated in the adjustment toner image 18K as described above. Further, since the potential of the photosensitive drum 1*d*, in which the adjustment toner images 18 of Y, M, and C colors overlap, is −900 V, the adjustment toner images 18 of Y, M, and C colors can pass through the nip N1*d* without being re-transferred by the photosensitive drum 1*d*.

According to the present exemplary embodiment, the adjustment toner image 18 of Y, M, C, and K colors, which is longer than the circumferential length of the photosensitive drum 1*a*, 1*b*, 1*c*, or 1*d*, is formed in the pre-rotation. However, it is not limited thereto. A long adjustment toner image may be formed between the images while continuously forming the images.

Further, according to the present exemplary embodiment, the toner image 18 of Y, M, C, and K colors is transferred from the photosensitive drum 1*a*, 1*b*, 1*c*, or 1*d* to the intermediate transfer belt 10, i.e., the transfer material. However, it is not limited thereto. The toner image 18 of Y, M, C, and K colors may be transferred from the photosensitive drum 1*a*, 1*b*, 1*c*, or ld to a recording material such as paper, i.e., a transfer material.

Furthermore, according to the present exemplary embodiment, the voltage application mode is executed when the length of the adjustment toner image 18 of Y, M, C, and K colors is longer than the circumferential length of the photosensitive drum 1*a*, 1*b*, 1*c*, or 1*d*. However, it is not limited thereto. For example, the voltage application mode may be executed when the length of the adjustment toner image 18 of Y, M, C, and K colors is longer than 1.5 times the circumferential length of the photosensitive drum 1*a*, 1*b*, 1*c*, or 1*d*. In such a case, the control unit 12 sets the first voltage Tr1 to a voltage of negative polarity (i.e., the first polarity) and less than the discharge start voltage, and the second voltage Tr2 to the voltage of negative polarity (i.e., the first polarity) and greater than or equal to the discharge start voltage. The voltage application mode can thus be executed when the length of the adjustment toner image 18 of Y, M, C, and K colors is longer than a predetermined value, which is longer than or equal to the circumferential length of the photosensitive drum 1*a*, 1*b*, 1*c*, or 1*d*.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-277692 filed Dec. 19, 2011, which is hereby incorporated by reference herein in its entirety.

What is claimed is:

1. An image forming apparatus comprising:

a rotatable photosensitive member;

an image forming unit configured to form a toner image on the photosensitive member;

a transfer member configured to transfer a toner image on the photosensitive member to a transfer material at a transfer portion;

an optical sensor disposed downstream of the image forming unit and upstream of the transfer member in a rotating direction of the photosensitive member, and configured to detect an adjustment toner image formed by the image forming unit by irradiating the photosensitive member with light;

a voltage application member configured to apply a voltage on the transfer member;

an adjustment unit configured to adjust image forming conditions of the image forming unit based on a result of the detection by the optical sensor; and an execution unit configured to execute a voltage application mode for applying, in the case where the adjustment toner image, which is longer than a predetermined value that is greater than or equal to a circumferential length of the photosensitive member in the rotating direction of the photosensitive member, is to be formed, a voltage of a same polarity as a charge polarity of toner and less than a discharge start voltage to the transfer member while a region of the photosensitive member which the optical sensor has irradiated with light passes through the transfer portion, and a voltage of the same polarity as the charge polarity of the toner and greater than or equal to the discharge start voltage to the transfer member while the photosensitive member rotates at least once after the region of the photosensitive member which the optical sensor has irradiated with light passes through the transfer portion.

2. The image forming apparatus according to claim 1, wherein, in the case where the adjustment toner image of a length which is less than or equal to the predetermined value is to be formed, the execution unit does not execute the voltage application mode.

3. The image forming apparatus according to claim 1, wherein, in the case where the adjustment toner image of a length which is less than or equal to the predetermined value is to be formed, the execution unit applies a voltage of the same polarity and greater than or equal to the discharge start voltage to the transfer member while the region of the photosensitive member which the optical sensor has irradiated with light passes through the transfer portion.

4. The image forming apparatus according to claim 1, wherein the execution unit executes the voltage application mode in a region before an image region of the photosensitive member, and wherein the execution unit does not execute the voltage application mode in a region between image regions of the photosensitive member.

5. The image forming apparatus according to claim 1, wherein the predetermined value includes the circumferential length of the photosensitive member corresponding to one rotation.

6. An image forming apparatus comprising:

a rotatable intermediate transfer member configured to bear a toner image;

a first image forming unit configured to form a first adjustment toner image on the intermediate transfer member;

a rotatable photosensitive member arranged downstream of the first image forming unit in a rotating direction of the intermediate transfer member;

a second image forming unit configured to form a toner image on the photosensitive member;

a transfer member configured to transfer the toner image on the photosensitive member to the intermediate transfer member at a transfer portion;

an optical sensor disposed downstream of the second image forming unit and upstream of the transfer member in a rotating direction of the photosensitive member, and configured to detect a second adjustment toner image formed by the second image forming unit by irradiating the photosensitive member with light;

a voltage application member configured to apply a voltage to the transfer member;

an adjustment unit configured to adjust image forming conditions of the second image forming unit based on a result of the detection by the optical sensor; and an execution unit configured to execute a voltage application mode for applying, in the case where the second adjustment toner image, which is longer than a predetermined value that is greater than or equal to a circumferential length of the photosensitive member in the rotating direction of the photosensitive member, is to be formed, a voltage of a same polarity as a charge polarity of toner and less than a discharge start voltage to the transfer member while a region of the photosensitive member which the optical sensor has irradiated with light passes through the transfer portion, and a voltage of the same polarity as the charge polarity of the toner and greater than or equal to the discharge start voltage to the transfer member while the photosensitive member rotates at least once after the region of the photosensitive member which the optical sensor has irradiated with light passes through the transfer portion.

* * * * *